United States Patent [19]

Saito

[11] Patent Number: 4,627,527

[45] Date of Patent: Dec. 9, 1986

[54] BALUSTRADE FOR PASSENGER CONVEYOR

[75] Inventor: Chuichi Saito, Katsuta, Japan

[73] Assignee: Hitachi, Ltd., Tokyo, Japan

[21] Appl. No.: 670,889

[22] Filed: Nov. 13, 1984

Related U.S. Application Data

[63] Continuation of Ser. No. 437,307, Oct. 28, 1982, abandoned.

[30] Foreign Application Priority Data

Oct. 30, 1981 [JP] Japan ..... 56-172743
Apr. 28, 1982 [JP] Japan ..... 57-70477

[51] Int. Cl.[4] ..... B66B 23/22
[52] U.S. Cl. ..... 198/335
[58] Field of Search ..... 198/335, 337, 338, 321, 198/336

[56] References Cited

U.S. PATENT DOCUMENTS 3,321,059 5/1967 Kroepel ..... 198/335
3,353,650 11/1967 Schroeder et al. ..... 198/335
3,991,877 11/1976 Kraft et al. ..... 198/335
4,159,758 7/1979 Courson ..... 198/335
4,273,232 6/1981 Saito et al. ..... 198/335

FOREIGN PATENT DOCUMENTS 53-16287 2/1978 Japan ..... 198/335
54-15286 2/1979 Japan ..... 198/335

*Primary Examiner*—Robert J. Spar
*Assistant Examiner*—Jonathan D. Holmes
*Attorney, Agent, or Firm*—Antonelli, Terry & Wands

[57] ABSTRACT

A balustrade for a passenger conveyor includes a glass panel, an inner deck cover located inside the glass panel, an outer deck cover located outside the glass panel, and a packing mounted between the glass panel and the inner and outer deck covers. The packing is of unitary structure formed of hard material, and is formed with a groove for receiving a lower end portion of the glass panel, and grooves for receiving end portions of the inner and outer deck covers. The packing is bolted to a support bed at its side while holding the glass panel at its lower portion.

3 Claims, 10 Drawing Figures

BALUSTRADE FOR PASSENGER CONVEYOR

This application is a continuation of application Ser. No. 437,307 filed Oct. 28, 1982, now abandoned.

BACKGROUND OF THE INVENTION

This invention relates to passenger conveyors, such as moving stairways or escalators, moving passageways, etc., and, more particularly, to a balustrade for a passenger conveyor including a deck cover portion of an improved construction.

Passengers conveyors have been popular and are widely used as important transportation facilities within buildings, sheds, etc. In recent years, a variety of needs have been created for this type of public conveyance with regard to a shortening of the time required for building them, improvements in their designs, etc.

Particularly in respect of the improvements in the design of a passenger conveyor, importance is placed on the balustrades thereof, and the tendency is that newly constructed passenger conveyors are provided with glass panels which are transparent and presentable in appearance. Generally, a glass panel has an inner deck cover and an outer deck cover, which are formed of material other than glass, positioned in abutting relation to the lower portion of the glass panel. To avoid production of a gap between the lower end portion of the glass panel and the inner and outer deck covers at their abutting ends, packings of soft material are mounted between the glass panel and the deck covers at their abutting ends.

However, a small gap tends to be formed between the glass panel and the packings covering the inner and outer deck covers on account of errors in fabrication or assembling, and such gap is inevitable if the present design is continued to be adopted. Such gap not only mars the appearance of the passenger conveyor but also gives rise to problems with regard to the safety of the passengers. For example, children might have their fingers stuck in the gap. Moreover, the inner and outer deck covers tend to have a difference in level between them and this has presented a rather ugly appearance.

SUMMARY OF THE INVENTION

This invention has as its object the provision of a balustrade for a passenger conveyor which is superior to balustrades of the prior art in appearance, safety of passengers and economy.

The aforesaid object is accomplished according to the invention by providing a balustrade wherein a packing mounted between the glass panel and the inner and outer deck covers located on the inner and outer sides of the glass panel respectively is of unitary structure formed of hard material including a groove for receiving a lower end portion of the glass panel and grooves for receiving end portions of the inner and outer deck covers respectively, and the unitary structure is bolted to the support bed at its side while holding the glass panel at its lower portion.

DETAILED DESCRIPTION

Figure 1:
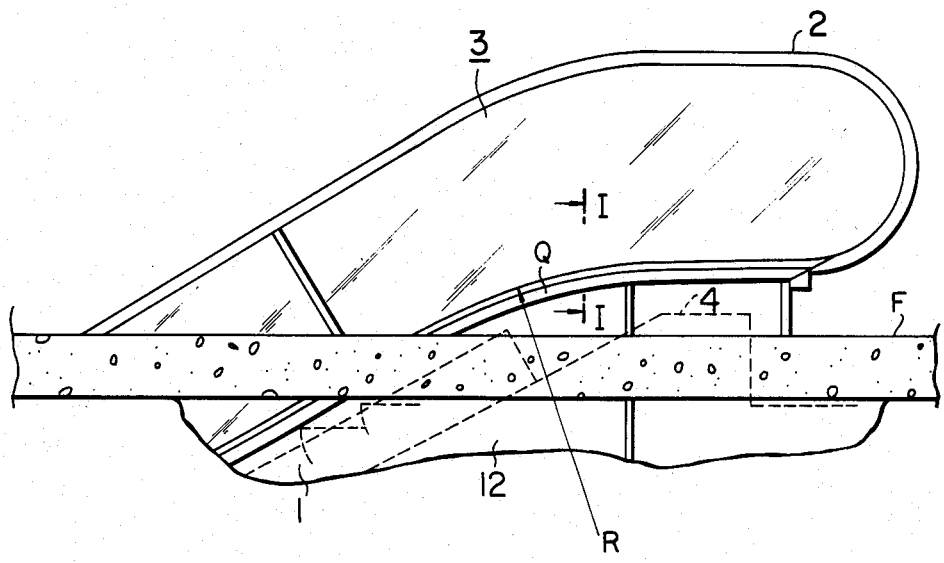
FIG. 1 is a side view of a passenger conveyor to which the invention may be applied, showing an upper landing portion thereof.

Referring to FIG. 1, a passenger conveyor comprises movable members including a plurality of steps 1 arranged like an endless belt for movement and a plurality of handrails 2 each located on either side of the steps 1, and stationary members comprising balustrades 3 each supporting one of the handrails thereon, a main body frame 4, etc. The passenger conveyor is supported by a building floor F.

Figure 2:
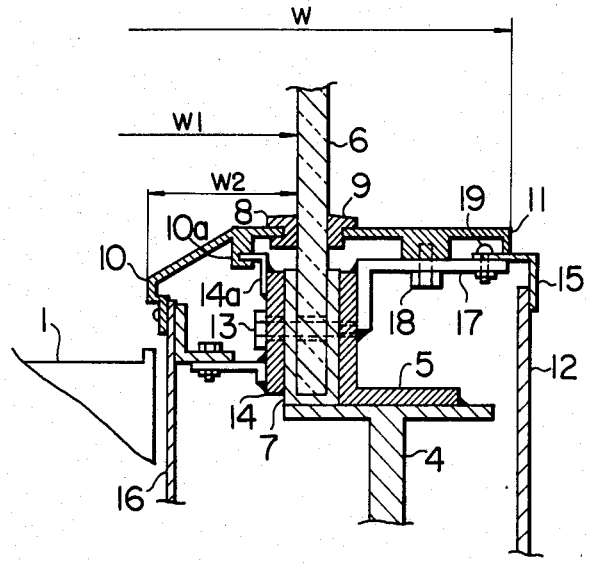
FIG. 2 PRIOR ART
FIG. 2 is a sectional view taken along the line II—II in FIG. 1, showing the construction of a balustrade of the prior art.

Referring to FIG. 2, the balustrades 3 of the prior art each compise a plurality of balustrade components supported on a support bed 5 secured to the main body frame 4 and including a glass panel 6, packings 7, 8 and 9, an inner deck cover 10, an outer deck cover 11 and an outer board 12. The glass panel 6 is held in place at its lower end portion which is in pressing engagement with a pressing plate 14 bolted to the support bed 5 as indicated at 13, and supports at its upper end the associated handrail 2 for movement. The balustrade 3 has arranged at its lower portion decorative members including the inner deck cover 10 located on the side of the glass panel 6 adjacent the steps 1, the outer deck cover 11 located on the side of the glass panel 6 adjacent the outer board 12, and a molding plate 15 connected to the outer deck cover 11 at one end and to the outer board 12 at the other end.

The inner deck cover 10 extends from a skirt guard 16 located on the side of the steps 1 so as to enclose the same to the glass panel 6 and has at its back an engaging portion **10*a* which receives therein an engaging portion 14*a* of the pressing plate 14 for engagement with each other to maintain strength for the inner deck cover 10. Meanwhile, the outer deck cover 11 and the molding plate 15 are supported by a support member 17 connected to the support bed 5, and bolted thereto as indicated at 18 and 19**, respectively.

In the balustrade 3, the decorative members, particularly the packings 8 and 9 and inner and outer deck covers 10 and 11 constituting surface portions, are members having a direct bearing on the decorative value of the passenger conveyor, and it is of high importance whether the external appearance and combination of the members are acceptable.

Particularly in the balustrade 3, members formed of dissimilar materials are in abutting engagement with each other in the vicinity of the glass panel 6 and the appearance of these members attract attention. Thus, the presence of gaps or differences in level in this section of the passenger conveyor or in the vicinity of the glass panel is frowned upon.

Figure 3:
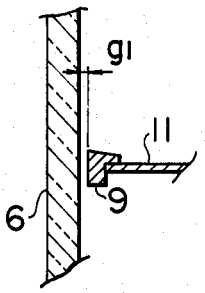
FIG. 3 PRIOR ART
FIGS. 3, 4 and 5 are sectional views of portions of balustrades of the prior art in explanation of the defects thereof.
Figure 4:
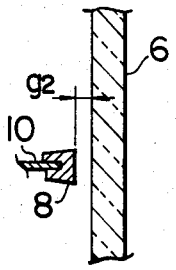
FIG. 4 PRIOR ART
Figure 5:
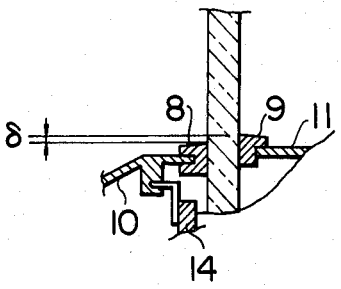
FIG. 5 PRIOR ART

The undesirable gaps which would be formed in the vicinity of the glass panel 6 are designated by $g_1$ and $g_2$ in FIGS. 3 and 4, respectively. The gap $g_1$ on the outer side of the glass panel 6 would be formed when the spacing $W_1$ between the glass panels 6 is too small as compared with the spacing W between outer ends of the outer deck covers 11 when the balustrades 3 are assembled. The gap $g_2$ on the inner side of the glass panel 6 would be formed when the assembling spacing $W_2$ for the inner deck cover 10 is short of the predetermined value. The gaps $g_1$ and $g_2$ are formed due to an accumulation of production tolerances of balustrade components or an inevitable error commited in assembling the components. However, these gaps should be eliminated not only to make the external appearance acceptable but also to provide for the safety of the passengers such as children who tend to have their fingers stuck in the gaps. Another defect of the balustrades of the prior art is the presence of a difference δ in level shown in FIG. 5. Generally, the inner deck cover 10 and outer deck cover 11 are assembled with a predetermined curvature R as shown in FIG. 1. An error that might be made in the height of the support bed 5 and the pressing plate 14 shown in FIG. 2 would result in the unacceptable formation of the difference δ as shown in FIG. 5.

The gaps $g_1$ and $g_2$ are structural defects resulting from errors committed with regard to the inner and outer deck covers 10 and 11 and are due to the fact that the packings 8 and 9 are bonded to or fitted in the inner and outer deck covers 10 and 11, respectively. Meanwhile, the difference δ in level is accounted for by the fact that the pressing plate 14 serving as a reference for asssembling the inner deck cover 10 is formed with an opening for inserting the bolt 13, which opening has a larger diameter than the bolt 13, and the fact that the bolt 13 might move vertically in the opening, or that difficulties are encountered in positioning the outer deck cover 11 because of the presence of the glass panel 6.

Figure 6:
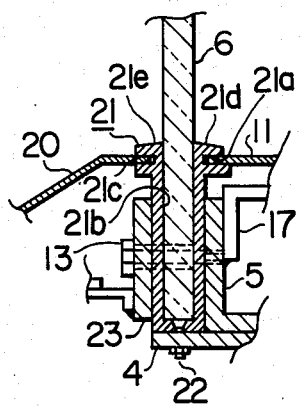
FIG. 6 is a sectional view similar to FIG. 2 but showing the balustrade construction according to an embodiment of the invention.
Figure 7:
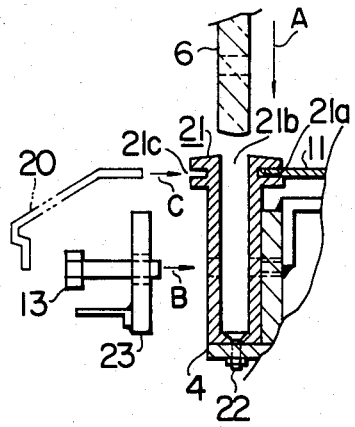
FIG. 7 is a sectional view showing the manner in which the balustrade construction shown in FIG. 6 is installed.

In accordance with the invention, as shown in FIG. 6, the glass panel 6 and the handrail 2 supported thereon as well as the arrangement of the support bed 5 and molding plate (not shown) are no different from the counterparts in the prior art however, an inner deck cover 20, corresponding to the inner deck cover 10 of the prior art, and an outer deck cover 11, corresponding to the outer deck cover 11 of the prior art, are fitted at their ends on the glass panel 6 side in a packing 21 of rigid or hard material formed as a single entity. In this case, the packing 21 is formed with a groove 21*a* for receiving the outer deck cover 11, a groove 21*b* for receiving the glass panel 6 and a groove 21*c* for receiving the inner deck cover 20. FIG. 7 shows the order in which the components of the balustrades 3 shown in FIG. 6 are assembled. The outer deck cover 11 that has been assembled is fitted in the groove 21*a* and the packing 21 is secured at its lower end to the main body frame 4 by screws 22 to bring the packing 21 to an upright position. Then a pressing plate 23 is forced against the packing 21 from the step 1 side after the glass panel 6 is inserted in the groove 21*b* as indicated by an arrow A, and the pressing plate 23 is connected to the packing 21 by the bolts 13 (see an arrow B). Then the deck cover 20 is inserted in the groove 21*c* as indicated by an arrow C, to thereby complete assembling. The packing 21 which is formed of rigid material, such as hard plastics or aluminum alloy, has its surfaces 21*d* and 21*e* beautifully finished for decorative purposes. What is noteworthy in the aforesaid construction is that the grooves 21*a* and 21*c* are at the same elevation or level and the inner deck cover 20 is supported by the packing 21 itself. This naturally brings the inner deck cover 20 and the outer deck cover 11 to the same height and production of the difference δ described by referring to the prior art can be eliminated. Moreover, the inner deck cover 20 and the outer deck cover 11 can be shifted horizontally while their vertical positions are regulated by the depths of the grooves 21*c* and 21*a*, so that production of the gaps $g_1$ and $g_2$ described by referring to the prior art can be eliminated. Also, the inner deck cover 20 does not require the arrangement of the prior art in which it is secured in place by insertion of the engaging portion 14*a* in the engaging portion 10*a* as shown in FIG. 2, and the inner deck cover 20 can be secured in place merely by fitting same in the groove 21*c* in the packing 21. Thus the invention is conductive to a reduction in cost.

It will be appreciated that the balustrades of the improved construction according to the invention can achieve the marked effects in avoiding production of gaps or differences in level that may otherwise occur in the vicinity of the glass panel 6 as is the case of the prior art.

The packing 21 according to the invention is formed of rigid material and this presents problems in manufacturing the packing 21 to conform to the inner deck cover 20 and outer deck cover 11 at a curved section Q in FIG. 1 having the curvature R. In order to make the packing conform to the inner deck cover 20 and outer deck cover 11 at the curved section Q, the packing 21 is subjected to a bending operation by heating the same, which raises problems with regard to how to minimize an increase in cost and how to obtain necessary precision finishes.

Figure 8:
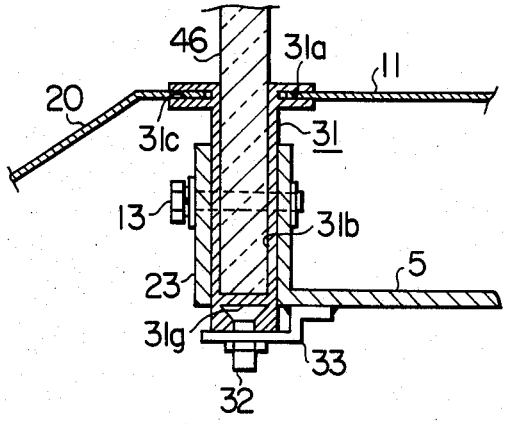
FIG. 8 is a sectional view of the balustrade construction according to another embodiment.
Figure 9:
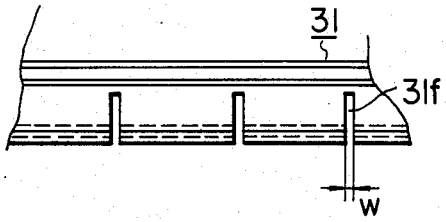
FIG. 9 is a side view of a packing.
Figure 10:
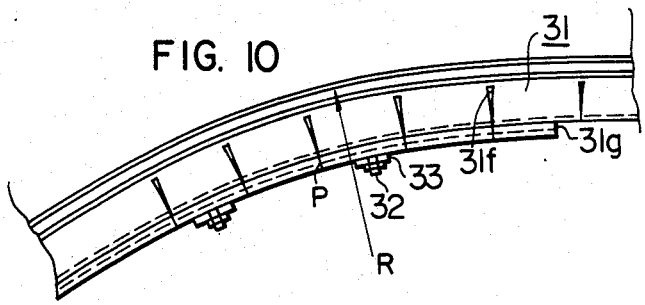
FIG. 10 is a side view of the packing shown in FIG. 9, showing the manner in which it is mounted.

The structure shown in FIGS. 8 to 10 avoids these problems in that a packing 31, arranged in the curved section Q (see FIG. 1) of the passenger conveyor, is formed with a plurality of cuts 31*f* of a width w of, for example, approximately, 2 to 5 mm, arranged with a relatively small spacing interval. The packing 31 is secured, by screws 32 fitted at their heads in a groove 31*g* formed in a lower portion of the packing 31 in the curved section Q of the passenger conveyor, to support pieces 33 located on the support bed 5 with a suitable spacing interval. The groove 31*g* does not exist in sections of the passenger conveyor where the packing 31 is located in a substantially horizontal position as shown in FIG. 10, and exists only in the curved section Q. Thus, the cuts 31*f* formed in the packing 31 are closed as indicated by P in FIG. 10 at the time the outer deck cover 11 is fitted in the groove 31*a*, so that the packing 31 conforms to the outer deck cover 11 in curvature and is secured by the screws 32 while in this condition. In this way, the packing 31 is maintained at the desired curvature for a prolonged period of time.

Meanwhile the inner deck cover 20 is fitted in a groove 31*c* formed in the packing 31. In this case, since the packing 31 is formed of rigid material, any deviation of the curvature of the inner deck cover 20 from that of the outer deck cover 11 can be corrected by the groove 31*c* of the packing 31. Thus, the inner deck cover 20 and the outer deck cover 11 which are important elements for maintaining the decorative value of the passenger conveyor at a high level can be kept at the same height. The glass panel 6 is fitted in a groove 31*b* in the packing 31.

By virtue of the aforesaid features, the packing 31 can be made to conform to the outer deck cover 11 in curvature R, and fixing in place of the packing 31 can be achieved positively by the combination of the groove 31g and the screws 32. In addition, the inner deck cover 20 and the outer deck cover 11 can have their heights brought to the same level, thereby contributing to maintenance of the decorative value of the passenger conveyor at a high level and elimination of high cost and unacceptable appearance.

The description has been made solely by referring to the convex curved portion of the passenger conveyor. However, the structure shown in FIGS. 8 to 10 can have application to a concave curved section located in the vicinity of a lower boarding area of the passenger conveyor. In this case, the portions indicated at P in FIG. 10 open to achieve the same effects as achieved by the convex curved portion.

From the foregoing description, it will be appreciated that the invention enables assembling of the packings to be accomplished with increased efficiency and allows the safety of the passengers to be increased while enabling the decorative level of the decorative members of the passenger conveyor to be raised.

What is claimed is:

1. A balustrade for passenger conveyor, the balustrade comprising:

a glass panel located beneath a movable endless handrail;

an inner deck cover and an outer deck cover respectively located inside and outside a lower portion of said glass panel;

a packing mounted between said glass panel and said inner and outer deck cover;

a support bed for supporting said glass panel;

said packing being of a unitary structure formed of a hard material and including a groove for receiving a lower end portion of the glass panel without forming a gap therebetween and grooves formed in an upper portion of said packing at both sides of the latter for respectively receiving end portions of the inner and outer deck covers, said packing being disposed so that one side surface thereof is in contact with the support bed and being threadably secured at a lower end thereof to a main body frame or a support member;

a pressing plate disposed on an opposite side surface of the packing and being in contact therewith; and bolt means extending through said pressing plate, said packing and said glass panel for securing the pressing plate, packing and glass panel to said support bed so as to provide a stable support of the glass panel whereby the glass panel is prevented from being displaced in an upward and downward direction.

2. A balustrade for a passenger conveyor as claimed in claim 1, wherein said packing is formed with a plurality of elongated cuts extending from a lower end of the packing to a portion thereof below the grooves for receiving the deck covers to enable the packing to bend at a curved section of said balustrade.

3. A balustrade for a passenger conveyor as claimed in claim 2, wherein said packing is formed at the lower end thereof with a groove for receiving fasteners.

* * * * *